US006468705B2

(12) United States Patent
Ishimaru et al.

(10) Patent No.: US 6,468,705 B2
(45) Date of Patent: Oct. 22, 2002

(54) OPTICAL FIXING TONER

(75) Inventors: Seijiro Ishimaru; Yoshimichi Katagiri; Yasushige Nakamura; Shinichi Yaoi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/817,337

(22) Filed: Mar. 27, 2001

(65) Prior Publication Data

US 2002/0098432 A1 Jul. 25, 2002

(30) Foreign Application Priority Data

Nov. 21, 2000 (JP) ..... 2000-354898

(51) Int. Cl.[7] ..... G03G 9/00
(52) U.S. Cl. ..... 430/108.21; 430/108.1
(58) Field of Search ..... 430/108.21, 108.1

(56) References Cited

FOREIGN PATENT DOCUMENTS

| | | | |
|---|---|---|---|
| JP | 62-061069 | * | 3/1987 |
| JP | 62-061070 | * | 3/1987 |

OTHER PUBLICATIONS

English Language Abstract of JP 62–061069.*
English Language Abstract of JP 62–061070.*

* cited by examiner

*Primary Examiner*—Mark Chapman
(74) *Attorney, Agent, or Firm*—Armstrong, Westerman & Hattori, LLP

(57) ABSTRACT

An optical fixing toner includes an infrared ray absorbing agent which is made of one element or a mixture of a plurality of elements 5 selected from a group of elements consisting of oxides, sulfides, halides, complex salts and acid chlorides of lanthanoide.

16 Claims, 8 Drawing Sheets

FIG.1A

| MATERIAL | TONER NAME | TONER1 | TONER2 | TONER3 | TONER4 | TONER5 | TONER6 |
|---|---|---|---|---|---|---|---|
| | | (wt.%) | (wt.%) | (wt.%) | (wt.%) | (wt.%) | (wt.%) |
| (RESIN USED) WEIGHT PERCENT | POLYESTER RESIN | 89.0 | 89.0 | 89.0 | 89.0 | 89.0 | 89.0 |
| PIGMENT/DYE | CALIXARENE-BASED COMPOUND | 4.0 | 4.0 | 4.0 | 4.0 | 4.0 | 4.0 |
| | | | | | | | |
| CHARGE CONTROL AGENT | POTASSIUM ALLENE-BASED COMPOUND | 1.0 | 1.0 | 1.0 | 1.0 | 1.0 | 1.0 |
| | | | | | | | |
| INFRARED RAY ABSORBING AGENT (LANTHANOIDE-BASED COMPOUND) | YTTERBIUM PHOSPHATE ($Yb_2PO_4$) | 5.0 | | | | | |
| | YTTERBIUM OXIDE ($Yb_2O_3$) | | 5.0 | | | | |
| | YTTERBIUM CHLORIDE ($YbCl_3$) | | | 5.0 | | | |
| | YTTERBIUM SULFIDE ($Yb_2S_3$) | | | | 5.0 | | |
| | PHOSPHATE SALT OXIDE OF YTTERBIUM | | | | | 5.0 | |
| | LANTHANOIDE OXIDE ($La_2O_3$) | | | | | | 5.0 |
| | PRASEODYMIUM OXIDE ($Pr_6O_{11}$) | | | | | | |
| | NEODYMIUM OXIDE ($Nd_2O_3$) | | | | | | |
| | SAMARIUM OXIDE ($Sm_2O_3$) | | | | | | |
| | TERBIUM OXIDE ($Tb_4O_7$) | | | | | | |
| | DYSPROSIUM OXIDE ($Dy_2O_3$) | | | | | | |
| | HOLMIUM OXIDE ($Ho_2O_3$) | | | | | | |
| | ERBIUM OXIDE ($Er_2O_3$) | | | | | | |
| | THULIUM OXIDE ($Tm_2O$) | | | | | | |
| | YTTERBIUM PHOSPHATE NEODYNIUM COMPLEX SALT($YbNdPO_4$) | | | | | | |
| | | | | | | | |
| | | | | | | | |
| INFRARED RAY ABSORBING AGENT (AMINIUM-BASED COMPOUND) | AMINIUM-SALT-BASED COMPOUND | | | | | | |
| | DIIMOMIUM-SALT-BASED COMPOUND | | | | | | |
| | | | | | | | |
| WAX | POLYPROPYLENE | 1.0 | 1.0 | 1.0 | 1.0 | 1.0 | 1.0 |
| | | | | | | | |
| TONER BASE | | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 |
| | YTTERBIUM PHOSPHATE POWDER(GRAIN DIAMETER=0.3$\mu$m) | | | | | | |
| | | | | | | | |
| DEVELOPING AGENT NAME | | DEVELOPING AGENT 1 | DEVELOPING AGENT 2 | DEVELOPING AGENT 3 | DEVELOPING AGENT 4 | DEVELOPING AGENT 5 | DEVELOPING AGENT6 |
| TONER TEMPERATURE | | 4.5% | 4.5% | 4.5% | 4.5% | 4.5% | 4.5% |

FIG.1B

| MATERIAL | TONER NAME | TONER7 | TONER8 | TONER9 | TONER10 | TONER11 | TONER12 |
|---|---|---|---|---|---|---|---|
| | | (wt.%) | (wt.%) | (wt.%) | (wt.%) | (wt.%) | (wt.%) |
| (RESIN USED) WEIGHT PERCENT | POLYESTER RESIN | 89.0 | 89.0 | 89.0 | 89.0 | 89.0 | 89.0 |
| PIGMENT/DYE | QUINACRIDONE-BASED COMPOUND | 4.0 | 4.0 | 4.0 | 4.0 | 4.0 | 4.0 |
| | | | | | | | |
| CHARGE CONTROL AGENT | CALIXARENE-BASED COMPOUND | 1.0 | 1.0 | 1.0 | 1.0 | 1.0 | 1.0 |
| | | | | | | | |
| INFRARED RAY ABSORBING AGENT (LANTHANOIDE-BASED COMPOUND) | YTTERBIUM PHOSPHATE ($Yb_2PO_4$) | | | | | | |
| | YTTERBIUM OXIDE ($Yb_2O_3$) | | | | | | |
| | YTTERBIUM CHLORIDE ($YbCl_3$) | | | | | | |
| | YTTERBIUM SULFIDE ($Yb_2S_3$) | | | | | | |
| | PHOSPHATE SALT OXIDE OF YTTERBIUM | | | | | | |
| | LANTHANOIDE OXIDE ($La_2O_3$) | | | | | | |
| | PRASEODYMIUM OXIDE ($Pr_6O_{11}$) | 5.0 | | | | | |
| | NEODYMIUM OXIDE ($Nd_2O_3$) | | 5.0 | | | | |
| | SAMARIUM OXIDE ($Sm_2O_3$) | | | 5.0 | | | |
| | TERBIUM OXIDE ($Tb_4O_7$) | | | | 5.0 | | |
| | DYSPROSIUM OXIDE ($Dy_2O_3$) | | | | | 5.0 | |
| | HOLMIUM OXIDE ($Ho_2O_3$) | | | | | | 5.0 |
| | ERBIUM OXIDE ($Er_2O_3$) | | | | | | |
| | THULIUM OXIDE ($Tm_2O$) | | | | | | |
| | YTTERBIUM PHOSPHATE NEODYNIUM COMPLEX SALT($YbNdPO_4$) | | | | | | |
| | | | | | | | |
| | | | | | | | |
| INFRARED RAY ABSORBING AGENT (LANTHANOIDE-BASED COMPOUND) | AMINIUM-SALT-BASED COMPOUND | | | | | | |
| | DIIMOMIUM-SALT-BASED COMPOUND | | | | | | |
| | | | | | | | |
| WAX | POLYPROPYLENE | 1.0 | 1.0 | 1.0 | 1.0 | 1.0 | 1.0 |
| | | | | | | | |
| TONER BASE | | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 |
| | YTTERBIUM PHOSPHATE POWDER(GRAIN DIAMETER=0.3$\mu$m) | | | | | | |
| | | | | | | | |
| DEVELOPING AGENT NAME | | DEVELOPING AGENT 7 | DEVELOPING AGENT 8 | DEVELOPING AGENT 9 | DEVELOPING AGENT 10 | DEVELOPING AGENT 11 | DEVELOPING AGENT 12 |
| TONER TEMPERATURE | | 4.5% | 4.5% | 4.5% | 4.5% | 4.5% | 4.5% |

FIG.2A

| MATERIAL | TONER NAME | TONER13 | TONER14 | TONER15 | TONER16 | TONER17 | TONER18 |
|---|---|---|---|---|---|---|---|
| | | (wt.%) | (wt.%) | (wt.%) | (wt.%) | (wt.%) | (wt.%) |
| (RESIN USED) WEIGHT PERCENT | POLYESTER RESIN | 89.0 | 89.0 | 89.0 | 93.9 | 74.0 | 94.0 |
| PIGMENT/DYE | QUINACRIDONE-BASED COMPOUND | 4.0 | 4.0 | 4.0 | 4.0 | 4.0 | 4.0 |
| | | | | | | | |
| CHARGE CONTROL AGENT | CALIXARENE-BASED COMPOUND | 1.0 | 1.0 | 1.0 | 1.0 | 1.0 | 1.0 |
| | | | | | | | |
| INFRARED RAY ABSORBING AGENT (LANTHANOIDE-BASED COMPOUND) | YTTERBIUM PHOSPHATE ($Yb_2PO_4$) | | | | 0.1 | 20.0 | 0.0 |
| | YTTERBIUM OXIDE ($Yb_2O_3$) | | | | | | |
| | YTTERBIUM CHLORIDE ($YbCl_3$) | | | | | | |
| | YTTERBIUM SULFIDE ($Yb_2S_3$) | | | | | | |
| | PHOSPHATE SALT OXIDE OF YTTERBIUM | | | | | | |
| | LANTHANOIDE OXIDE ($La_2O_3$) | | | | | | |
| | PRASEODYMIUM OXIDE ($Pr_6O_{11}$) | | | | | | |
| | NEODYMIUM OXIDE ($Nd_2O_3$) | | | | | | |
| | SAMARIUM OXIDE ($Sm_2O_3$) | | | | | | |
| | TERBIUM OXIDE ($Tb_4O_7$) | | | | | | |
| | DYSPROSIUM OXIDE ($Dy_2O_3$) | | | | | | |
| | HOLMIUM OXIDE ($Ho_2O_3$) | | | | | | |
| | ERBIUM OXIDE ($Er_2O_3$) | 5.0 | | | | | |
| | THULIUM OXIDE ($Tm_2O$) | | 5.0 | | | | |
| | YTTERBIUM PHOSPHATE NEODYNIUM COMPLEX SALT($YbNdPO_4$) | | | 5.0 | | | |
| | | | | | | | |
| | | | | | | | |
| INFRARED RAY ABSORBING AGENT (AMINIUM-BASED COMPOUND) | AMINIUM-SALT-BASED COMPOUND | | | | | | |
| | DIIMOMIUM-SALT-BASED COMPOUND | | | | | | |
| | | | | | | | |
| WAX | POLYPROPYLENE | 1.0 | 1.0 | 1.0 | 1.0 | 1.0 | 1.0 |
| | | | | | | | |
| TONER BASE | | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 |
| | YTTERBIUM PHOSPHATE POWDER(GRAIN DIAMETER=0.3$\mu$m) | | | | | | |
| | | | | | | | |
| DEVELOPING AGENT NAME | | DEVELOPING AGENT 13 | DEVELOPING AGENT 14 | DEVELOPING AGENT 15 | DEVELOPING AGENT 16 | DEVELOPING AGENT 17 | DEVELOPING AGENT 18 |
| TONER TEMPERATURE | | 4.5% | 4.5% | 4.5% | 4.5% | 4.5% | 4.5% |

FIG.2B

| MATERIAL | TONER NAME | TONER 19 | TONER 20 | TONER 21 | TONER 22 | TONER 23 | TONER 24 | TONER 25 |
|---|---|---|---|---|---|---|---|---|
| | | (wt.%) | (wt.%) | (wt.%) | (wt.%) | (wt.%) | (wt.%) | (wt.%) |
| (RESIN USED) WEIGHT PERCENT | POLYESTER RESIN | 70.0 | 92.5 | 78.0 | 93.0 | 75.0 | 89.9 | 85.5 |
| PIGMENT/DYE | QUINACRIDONE-BASED COMPOUND | 4.0 | 0.1 | 15.0 | 0.0 | 18.0 | 4.0 | 4.0 |
| | | | | | | | | |
| CHARGE CONTROL AGENT | CALIXARENE-BASED COMPOUND | 1.0 | 1.0 | 1.0 | 1.0 | 1.0 | 0.1 | 5.0 |
| | | | | | | | | |
| INFRARED RAY ABSORBING AGENT (LANTHANOIDE-BASED COMPOUND) | YTTERBIUM PHOSPHATE ($Yb_2PO_4$) | 24.0 | 5.0 | 5.0 | 5.0 | 5.0 | 5.0 | 5.0 |
| | YTTERBIUM OXIDE ($Yb_2O_3$) | | | | | | | |
| | YTTERBIUM CHLORIDE ($YbCl_3$) | | | | | | | |
| | YTTERBIUM SULFIDE ($Yb_2S_3$) | | | | | | | |
| | PHOSPHATE SALT OXIDE OF YTTERBIUM | | | | | | | |
| | LANTHANOIDE OXIDE ($La_2O_3$) | | | | | | | |
| | PRASEODYMIUM OXIDE ($Pr_6O_{11}$) | | | | | | | |
| | NEODYMIUM OXIDE ($Nd_2O_3$) | | | | | | | |
| | SAMARIUM OXIDE ($Sm_2O_3$) | | | | | | | |
| | TERBIUM OXIDE ($Tb_4O_7$) | | | | | | | |
| | DYSPROSIUM OXIDE ($Dy_2O_3$) | | | | | | | |
| | HOLMIUM OXIDE ($Ho_2O_3$) | | | | | | | |
| | ERBIUM OXIDE ($Er_2O_3$) | | | | | | | |
| | THULIUM OXIDE ($Tm_2O$) | | | | | | | |
| | YTTERBIUM PHOSPHATE NEODYNIUM COMPLEX SALT($YbNdPO_4$) | | | | | | | |
| | | | | | | | | |
| | | | | | | | | |
| INFRARED RAY ABSORBING AGENT (AMINIUM-BASED COMPOUND) | AMINIUM-SALT-BASED COMPOUND | | | | | | | |
| | DIIMOMIUM-SALT-BASED COMPOUND | | | | | | | |
| | | | | | | | | |
| WAX | POLYPROPYLENE | 1.0 | 1.0 | 1.0 | 1.0 | 1.0 | 1.0 | 1.0 |
| | | | | | | | | |
| TONER BASE | | 100 | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 | 0.8 |
| | YTTERBIUM PHOSPHATE POWDER(GRAIN DIAMETER=0.3$\mu$m) | | | | | | | |
| | | | | | | | | |
| DEVELOPING AGENT NAME | | DEVELOPING AGENT 19 | DEVELOPING AGENT 20 | DEVELOPING AGENT 21 | DEVELOPING AGENT 22 | DEVELOPING AGENT 23 | DEVELOPING AGENT 24 | DEVELOPING AGENT 25 |
| TONER TEMPERATURE | | 4.5% | 4.5% | 4.5% | 4.5% | 4.5% | 4.5% | 4.5% |

FIG.3A

| MATERIAL | TONER NAME | TONER 26 | TONER 27 | TONER 28 | TONER 29 | TONER 30 | TONER 31 |
|---|---|---|---|---|---|---|---|
| | | (wt.%) | (wt.%) | (wt.%) | (wt.%) | (wt.%) | (wt.%) |
| (RESIN USED) WEIGHT PERCENT | POLYESTER RESIN | 90.0 | 83.0 | 89.0 | 94.0 | 88.0 | 88.0 |
| PIGMENT/DYE | QUINACRIDONE-BASED COMPOUND | 4.0 | 4.0 | 4.0 | 4.0 | 4.0 | 4.0 |
| | | | | | | | |
| CHARGE CONTROL AGENT | CALIXARENE-BASED COMPOUND | 0.0 | 7.0 | 1.0 | 1.0 | 1.0 | 1.0 |
| | | | | | | | |
| INFRARED RAY ABSORBING AGENT (LANTHANOIDE-BASED COMPOUND) | YTTERBIUM PHOSPHATE ($Yb_2PO_4$) | 5.0 | 5.0 | 5.0 | 0.0 | 5.0 | 5.0 |
| | YTTERBIUM OXIDE ($Yb_2O_3$) | | | | | | |
| | YTTERBIUM CHLORIDE ($YbCl_3$) | | | | | | |
| | YTTERBIUM SULFIDE ($Yb_2S_3$) | | | | | | |
| | PHOSPHATE SALT OXIDE OF YTTERBIUM | | | | | | |
| | LANTHANOIDE OXIDE ($La_2O_3$) | | | | | | |
| | PRASEODYMIUM OXIDE ($Pr_6O_{11}$) | | | | | | |
| | NEODYMIUM OXIDE ($Nd_2O_3$) | | | | | | |
| | SAMARIUM OXIDE ($Sm_2O_3$) | | | | | | |
| | TERBIUM OXIDE ($Tb_4O_7$) | | | | | | |
| | DYSPROSIUM OXIDE ($Dy_2O_3$) | | | | | | |
| | HOLMIUM OXIDE ($Ho_2O_3$) | | | | | | |
| | ERBIUM OXIDE ($Er_2O_3$) | | | | | | |
| | THULIUM OXIDE ($Tm_2O$) | | | | | | |
| | YTTERBIUM PHOSPHATE NEODYNIUM COMPLEX SALT($YbNdPO_4$) | | | | | | |
| | | | | | | | |
| | | | | | | | |
| INFRARED RAY ABSORBING AGENT (AMINIUM-BASED COMPOUND) | AMINIUM-SALT-BASED COMPOUND | | | | | 1.0 | |
| | DIIMOMIUM-SALT-BASED COMPOUND | | | | | | 1.0 |
| | | | | | | | |
| WAX | POLYPROPYLENE | 1.0 | 1.0 | 1.0 | 1.0 | 1.0 | 1.0 |
| | | | | | | | |
| TONER BASE | | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 |
| | YTTERBIUM PHOSPHATE POWDER(GRAIN DIAMETER=0.3μm) | | | 0.5 | 0.5 | | |
| | | | | | | | |
| DEVELOPING AGENT NAME | | DEVELOPING AGENT 26 | DEVELOPING AGENT 27 | DEVELOPING AGENT 28 | DEVELOPING AGENT 29 | DEVELOPING AGENT 30 | DEVELOPING AGENT 31 |
| TONER TEMPERATURE | | 4.5% | 4.5% | 4.5% | 4.5% | 4.5% | 4.5% |

FIG.3B

| MATERIAL | TONER NAME | TONER 32 | TONER 33 | TONER 34 | TONER 35 | TONER 36 | TONER 37 | TONER 38 |
|---|---|---|---|---|---|---|---|---|
| | | (wt.%) | (wt.%) | (wt.%) | (wt.%) | (wt.%) | (wt.%) | (wt.%) |
| (RESIN USED) WEIGHT PERCENT | POLYESTER RESIN | 88.9 | 84.0 | 81.0 | 89.0 | 89.0 | 89.0 | 89.0 |
| PIGMENT/DYE | QUINACRIDONE-BASED COMPOUND | 4.0 | 4.0 | 4.0 | 4.0 | 4.0 | 1.0 | 1.0 |
| | | | | | | | | |
| CHARGE CONTROL AGENT | CALIXARENE-BASED COMPOUND | 1.0 | 1.0 | 1.0 | 1.0 | 1.0 | 5.0 | 5.0 |
| | | | | | | | | |
| INFRARED RAY ABSORBING AGENT (LANTHANOIDE-BASED COMPOUND) | YTTERBIUM PHOSPHATE ($Yb_2PO_4$) | 5.0 | 5.0 | 5.0 | | | | |
| | YTTERBIUM OXIDE ($Yb_2O_3$) | | | | | | | |
| | YTTERBIUM CHLORIDE ($YbCl_3$) | | | | | | | |
| | YTTERBIUM SULFIDE ($Yb_2S_3$) | | | | | | | |
| | PHOSPHATE SALT OXIDE OF YTTERBIUM | | | | | | | |
| | LANTHANOIDE OXIDE ($La_2O_3$) | | | | | | | |
| | PRASEODYMIUM OXIDE ($Pr_6O_{11}$) | | | | | | | |
| | NEODYMIUM OXIDE ($Nd_2O_3$) | | | | | | | |
| | SAMARIUM OXIDE ($Sm_2O_3$) | | | | | | | |
| | TERBIUM OXIDE ($Tb_4O_7$) | | | | | | | |
| | DYSPROSIUM OXIDE ($Dy_2O_3$) | | | | | | | |
| | HOLMIUM OXIDE ($Ho_2O_3$) | | | | | | | |
| | ERBIUM OXIDE ($Er_2O_3$) | | | | | | | |
| | THULIUM OXIDE ($Tm_2O$) | | | | | | | |
| | YTTERBIUM PHOSPHATE NEODYNIUM COMPLEX SALT($YbNdPO_4$) | | | | | | | |
| | | | | | | | | |
| | | | | | | | | |
| INFRARED RAY ABSORBING AGENT (AMINIUM-BASED COMPOUND) | AMINIUM-SALT-BASED COMPOUND | 0.1 | 5.0 | 8.0 | 5.0 | | | |
| | DIIMOMIUM-SALT-BASED COMPOUND | | | | | 5.0 | | |
| | | | | | | | | |
| WAX | POLYPROPYLENE | 1.0 | 1.0 | 1.0 | 1.0 | 1.0 | 1.0 | 1.0 |
| | | | | | | | | |
| TONER BASE | | 100 | 100 | 100 | 100 | 100 | 100 | 100 |
| EXTERNAL ADDITIVE | HYDROPHOBIC SILICA | 0.8 | 0.8 | 0.8 | 0.8 | 0.8 | 0.8 | 0.8 |
| | YTTERBIUM PHOSPHATE POWDER(GRIN DIAMETER=0.3$\mu$m) | | | | | | 2.0 | 0.1 |
| | | | | | | | | |
| DEVELOPING AGENT NAME | | DEVELOPING AGENT 32 | DEVELOPING AGENT 33 | DEVELOPING AGENT 34 | DEVELOPING AGENT 35 | DEVELOPING AGENT 36 | DEVELOPING AGENT 37 | DEVELOPING AGENT 38 |
| TONER TEMPERATURE | | 4.5% | 4.5% | 4.5% | 4.5% | 4.5% | 4.5% | 4.5% |

FIG.4A

| DEVELOPING AGENT NAME | DEVELOPING AGENT 1 | DEVELOPING AGENT 2 | DEVELOPING AGENT 3 | DEVELOPING AGENT 4 | DEVELOPING AGENT 5 | DEVELOPING AGENT 6 |
|---|---|---|---|---|---|---|
| TONER DENSITY | 4.5% | 4.5% | 4.5% | 4.5% | 4.5% | 4.5% |
| FIXING PERFORMANCE | ◎ | ◎ | ◎ | ◎ | ◎ | ○ |
| CHARGE CONTROL CHARACTERISTIC | ◎ | ◎ | ◎ | ◎ | ◎ | ◎ |
| INITIAL CHARGE ($\mu$C/g) | 20 | 20 | 21 | 19 | 22 | 22 |
| CHARGE AFTER 100,000 PRINTS ($\mu$C/g) | 19 | 19 | 19 | 18 | 20 | 19 |
| IMAGE EVALUATION | ◎ | ◎ | ◎ | ◎ | ◎ | ○ |

| DEVELOPING AGENT NAME | DEVELOPING AGENT 7 | DEVELOPING AGENT 8 | DEVELOPING AGENT 9 | DEVELOPING AGENT 10 | DEVELOPING AGENT 11 | DEVELOPING AGENT 12 |
|---|---|---|---|---|---|---|
| TONER DENSITY | 4.5% | 4.5% | 4.5% | 4.5% | 4.5% | 4.5% |
| FIXING PERFORMANCE | ○ | ◎ | ◎ | ○ | ◎ | ○ |
| CHARGE CONTROL CHARACTERISTIC | ◎ | ◎ | ◎ | ◎ | ◎ | ◎ |
| INITIAL CHARGE ($\mu$C/g) | 21 | 22 | 19 | 20 | 20 | 20 |
| CHARGE AFTER 100,000 PRINTS ($\mu$C/g) | 20 | 19 | 18 | 18 | 18 | 21 |
| IMAGE EVALUATION | ◎ | ◎ | ◎ | ◎ | ◎ | ◎ |

| DEVELOPING AGENT NAME | DEVELOPING AGENT 13 | DEVELOPING AGENT 14 | DEVELOPING AGENT 15 | DEVELOPING AGENT 16 | DEVELOPING AGENT 17 | DEVELOPING AGENT 18 |
|---|---|---|---|---|---|---|
| TONER DENSITY | 4.5% | 4.5% | 4.5% | 4.5% | 4.5% | 4.5% |
| FIXING PERFORMANCE | ○ | ○ | ◎ | ○ | ◎ | × |
| CHARGE CONTROL CHARACTERISTIC | ◎ | ◎ | ◎ | ◎ | ○ | ◎ |
| INITIAL CHARGE ($\mu$C/g) | 18 | 19 | 22 | 20 | 18 | 20 |
| CHARGE AFTER 100,000 PRINTS ($\mu$C/g) | 18 | 18 | 20 | 19 | 13 | 19 |
| IMAGE EVALUATION | ○ | ○ | ◎ | ◎ | ◎ | ◎ |

FIG.4B

| DEVELOPING AGENT NAME | DEVELOPING AGENT 19 | DEVELOPING AGENT 20 | DEVELOPING AGENT 21 | DEVELOPING AGENT 22 | DEVELOPING AGENT 23 | DEVELOPING AGENT 24 | DEVELOPING AGENT 25 |
|---|---|---|---|---|---|---|---|
| TONER DENSITY | 4.5% | 4.5% | 4.5% | 4.5% | 4.5% | 4.5% | 4.5% |
| FIXING PERFORMANCE | ◎ | ◎ | ◎ | ◎ | ◎ | ◎ | ◎ |
| CHARGE CONTROL CHARACTERISTIC | × | ◎ | ◎ | ◎ | ◎ | ○ | ○ |
| INITIAL CHARGE ($\mu$C/g) | 16 | 20 | 21 | 22 | 21 | 15 | 30 |
| CHARGE AFTER 100,000 PRINTS ($\mu$C/g) | 9 | 18 | 19 | 21 | 18 | 10 | 22 |
| IMAGE EVALUATION | ◎ | ○ | ○ | × | × | ◎ | ◎ |

| DEVELOPING AGENT NAME | DEVELOPING AGENT 26 | DEVELOPING AGENT 27 | DEVELOPING AGENT 28 | DEVELOPING AGENT 29 | DEVELOPING AGENT 30 | DEVELOPING AGENT 31 |
|---|---|---|---|---|---|---|
| TONER DENSITY | 4.5% | 4.5% | 4.5% | 4.5% | 4.5% | 4.5% |
| FIXING PERFORMANCE | ◎ | ◎ | ◎ | ◎ | ◎ | ◎ |
| CHARGE CONTROL CHARACTERISTIC | × | × | ◎ | ◎ | ◎ | ◎ |
| INITIAL CHARGE ($\mu$C/g) | 10 | 35 | 22 | 20 | 21 | 22 |
| CHARGE AFTER 100,000 PRINTS ($\mu$C/g) | 5 | 20 | 19 | 20 | 18 | 20 |
| IMAGE EVALUATION | ◎ | ◎ | ◎ | ◎ | ○ | ○ |

| DEVELOPING AGENT NAME | DEVELOPING AGENT 32 | DEVELOPING AGENT 33 | DEVELOPING AGENT 34 | DEVELOPING AGENT 35 | DEVELOPING AGENT 36 | DEVELOPING AGENT 37 | DEVELOPING AGENT 38 |
|---|---|---|---|---|---|---|---|
| TONER DENSITY | 4.5% | 4.5% | 4.5% | 4.5% | 4.5% | 4.5% | 4.5% |
| FIXING PERFORMANCE | ◎ | ◎ | ◎ | ◎ | ◎ | ○ | ◎ |
| CHARGE CONTROL CHARACTERISTIC | ◎ | ○ | × | ○ | ○ | ◎ | ◎ |
| INITIAL CHARGE ($\mu$C/g) | 20 | 15 | 10 | 16 | 16 | 20 | 20 |
| CHARGE AFTER 100,000 PRINTS ($\mu$C/g) | 18 | 10 | 3 | 11 | 10 | 19 | 19 |
| IMAGE EVALUATION | ◎ | ○ | × | ○ | ○ | ◎ | ◎ |

OPTICAL FIXING TONER

BACKGROUND OF THE INVENTION

This application claims the benefit of a Japanese Patent Application No. 2000-354898 filed Nov. 21, 2000, in the Japanese Patent Office, the disclosure of which is hereby incorporated by reference.

1. Field of the Invention

The present invention generally relates to optical fixing toners for use in visualizing an electrostatic latent image which is formed on a surface of a photoconductive insulator such as a photoconductive drum, and more particularly to an optical fixing toner which forms a toner image transferred onto a recording medium such as paper from a photoconductive insulator and is melted and fixed on the recording medium when irradiated with light.

2. Description of the Related Art

The electrophotography technique is one method of visualizing electronic image data on a recording medium. According to the electrophotography technique, an electrostatic latent image is formed on a surface of a photoconductive insulator, and a toner is adhered on the latent image to visualize the latent image into a toner image. Then, the toner image is transferred onto a recording medium such as paper, and a print is obtained by melting and solidifying the toner of the toner image on the recording medium.

The toner image is formed on the surface of the photoconductive insulator by applying a uniform electrostatic charge on the surface of the photoconductive insulator by corona discharge, for example, forming an electrostatic latent image by irradiating an optical image on the photoconductive insulator by an appropriate means, and adhering a charged toner on the electrostatic latent image by an electrical attracting force thereof. The toner which is used to develop the electrostatic latent image includes a binder resin which is made of a natural or synthetic polymer material admixed with a coloring agent, and an additive such as a charge control agent if necessary, and the toner grains have a diameter on the order to 1 to 3 $\mu$m.

As methods of fixing the toner image which is transferred onto the recording medium, there is a method which presses or heats or combines pressing and heating so as to melt and then solidify the toner, and an optical fixing method which irradiates light so as to melt and then solidify the toner.

Recently, much attention is drawn to the optical fixing method which uses light, because this method is unaffected by undesirable influences of the pressing and/or heating. In other words, the optical fixing method does not require the toner image to be pressed when fixing the toner, and for this reason, there is no need to make a fixing roller contact or press the toner image, and a deterioration of an image resolution or reproducibility during a fixing process is suppressed. In addition, there is no need to provide a heat source such as a heater within the fixing roller in order to heat the toner image. Therefore, according to the optical fixing method, it is unnecessary to wait until the heat source reaches a desired temperature after the power is turned ON, and the printing can be carried out immediately after the power is turned ON. Moreover, heat source, a temperature rise within an apparatus can appropriately be avoided. Furthermore, even when the recording medium is jammed within a fixing unit when the apparatus fails, for example, safety is ensured since there is no possibility of the jammed recording medium burning and generating fire due to the heat from the heat source.

When employing the optical fixing method, it has be conventionally proposed to add a light absorbing agent in the toner so that the toner can efficiently absorb and utilize the energy of the light irradiated thereon. For example, a Japanese Laid-Open Patent Application No.61-132959 proposes a method of melting the toner by irradiating light in an infrared region by use of a xenon flash lamp, wherein an aminium-salt-based compound or a diimomium-salt-based compound is added as an infrared ray absorbing agent. The aminium-salt-based compound or the like has a good infrared ray absorbing characteristic, and has a relatively light color tone in the visible region. Accordingly, it is possible to suppress undesirable effects on the color tone of the fixed image, and the aminium-salt-based compound or the like is suited for use as the infrared ray absorbing agent for a color toner.

However, as described above, the charge control agent may be added to the toner. The charge control agent is added to control the charge of the toner within a desired range, so as to enable an appropriate printing. The charge control agent is made of a polar compound such as tertiary amine having portions with high polarity or, a highly reactive ionic compound such as quaternary ammonium salt. But when a highly reactive compound such as the charge control agent exists within the toner, the counter ion within the aminium-salt-based compound or the like are subject to abstraction by the polar group or, an ion-exchange occurs between the counter ion and the ionic compound, thereby changing the structure of the aminium-salt-based compound or the like. In addition, due to the heating caused by the mulling carried out during the toner fabricating process, the aminium-based-salt compound or the like which are organic materials may undergo a structural change or react with the polar group. When such a structural change occurs, the light absorbing band (wavelength) shifts, and the infrared ray absorbing characteristic of the aminium-based-salt compound or the like deteriorates, such that the infrared absorbing characteristic is completely lost in a worst case.

On the other hand, the charge control agent also undergoes a structural change due to a reaction with the aminium-based-salt compound or the like, and the charge control characteristic is deteriorated thereby. Moreover, although the aminium-based-salt compound or the like originally has the light color tone, the color tone is changed to a yellowish brown, for example, when the structural change of the charge control agent occurs. Such a change in the color tone affects the color tone of the color toner image after the fixing process. In the case of a red color toner, for example, the toner image on the recording medium after the fixing process becomes reddish brown when the structural change of the charge control agent occurs.

Therefore, the organic materials such as the aminium-based salt compound are relatively good infrared ray absorbing agents, but still require improvement to overcome the problems described above.

SUMMARY OF THE INVENTION

Accordingly, it is a general object of the present invention to provide a novel and useful optical fixing toner in which the problems described above are eliminated.

Another and more specific object of the present invention is to provide an optical fixing toner which eliminates the problems of the conventional infrared ray absorbing agent, by including an infrared ray absorbing agent which can realize a satisfactory infrared ray absorbing characteristic even when a polar compound such as tertiary amine having portions with high polarity or a highly reactive ionic compound such as quaternary ammonium salt coexists.

Still another object of the present invention is to provide an optical fixing toner comprising an infrared ray absorbing agent made of one element or a mixture of a plurality of elements selected from a group of elements consisting of oxides, sulfides, halides, complex salts and acid chlorides of lanthanoide. According to the optical fixing toner of the present invention, a lanthanoide-based compound is an essential constituent element of the infrared ray absorbing agent. Since the lanthanoide-based compound has absorption in the infrared region having a wavelength of 700 nm or greater, the lanthanoide-based compound gives the optical fixing toner an infrared ray absorbing characteristic. When an infrared ray is irradiated on the optical fixing toner of the present invention, the infrared ray having the wavelength of 700 nm or greater is efficiently absorbed by the lanthanoide-based compound, and an energy of the irradiated ray is transformed into a thermal energy which melts a binder resin of the optical fixing toner. Therefore, the optical fixing toner of the present invention has a good optical fixing characteristic.

In the optical fixing toner, a content of the infrared ray absorbing agent within the optical fixing toner may be in a range of approximately 0.1 to 20.0 weight percent.

In addition, at least a portion of the infrared ray absorbing agent may be externally added to surfaces of toner grains forming the optical fixing toner.

Moreover, the lanthanoide may be made of an element selected from a group of elements consisting of salts, complex salts and oxides of ytterbium, neodymium and samarium.

Further, the optical fixing toner may further comprises an aminium-salt-based compound described by a formula (1), and/or a diimomium-salt-based compound described by a formula (2), (1)

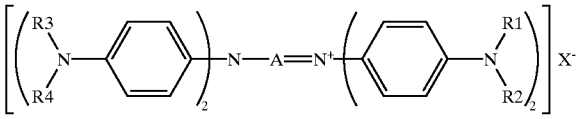

(2)

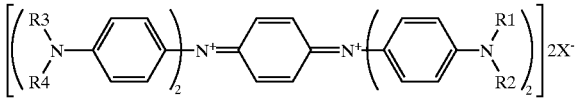

where R1 through R4 denote hydrogen atom, alkyl group, substitution alkyl group, cyclic alkyl group, alkenyl group, alalkyl group or substitution alalkyl group, A denotes a p-phenylnene group or p-biphenylene group, and X denotes negative ion.

Other objects and further features of the present invention will be apparent from the following detailed description when read in conjunction with the accompanying drawings.

BRIEF DESCRIPTION OF THE DRAWINGS

FIGS. 1A and 1B are diagrams showing components of a developing agent and mixture ratios thereof in an embodiment of an optical fixing toner according to the present invention;

FIGS. 2A and 2B are diagrams showing components of the developing agent and the mixture ratios thereof in the embodiment of the optical fixing toner according to the present invention;

FIGS. 3A and 3B are diagrams showing components of the developing agent and the mixture ratios thereof in the embodiment of the optical fixing toner according to the present invention; and FIGS. 4A and 4B are diagrams showing results of evaluation tests conducted with respect to the developing agents of the embodiment.

DESCRIPTION OF THE PREFERRED EMBODIMENTS

A description will be given of the operating principle of the present invention. An optical fixing toner of the present invention includes a binder resin, a coloring agent, a charge control agent, and an infrared ray absorbing agent. In other words, the basic structure of the optical fixing toner of the present invention is similar to that of the conventional optical fixing toner. However, in the present invention, a lanthanoid-based compound is used for the infrared ray absorbing agent, and the lanthanoid-based compound may also function as a coloring agent. Each component of the optical fixing toner of the present invention will now be described with reference to the characteristics thereof.

First, the binder resin may be made of any of various kinds of thermoplastic resins made of natural or synthetic polymers. For example, a resin having a weight-average molecular weight of approximately 4,000 to 100,000 and a melting point of approximately 90 to 150° C. may be suitably used for the binder resin. More particularly, an epoxy resin, a styrene-acrylic resin, a polyacrylic resin, a polyamide resin, a polyester resin, a polyvinyl resin, a polyurethane resin, a polybutadiene resin or appropriate combinations of selected ones of such resins may be used for the binder resin. Of such resins, the polyester resin is particularly suitable for use as the binder resin. Desirably, a binder resin content within the optical fixing toner is approximately 80 weight percent (wt. %) or greater.

The coloring agent may be made of a dye or a pigment. For example, it is possible to use a carbon black dye, a nigrosine dye, an azo dye or the like for the coloring agent when forming a black-based toner. It is possible to use an anthraquinone pigment, a quinacridone pigment, a bisazo-based dye, a monoazo-based dye or the like for the coloring agent when forming a red-based toner. It is possible to use an anilide compound dye, a benzidine dye, a benziimidazolon dye, a bisazo-based dye or the like for the coloring agent when forming a yellow-based toner. It is possible to use a phthalocyanine pigment or the like for the coloring agent when forming a blue-based toner It is possible to use a phthalocyanine halide pigment or the like for the coloring agent when forming a green-based toner. When the coloring agent content within the optical fixing toner is too small, the coloring of the image which is fixed on the recording medium deteriorates. On the other hand, when the coloring agent content within the optical fixing toner is too large, various characteristics such as the toner charge stability deteriorates, and the cost of the raw materials used for the optical fixing toner becomes high. Accordingly, it is desirable that the coloring agent content within the optical fixing toner is in a range of approximately 0.1 to 15 wt. %.

A charge control agent for controlling the charge of the optical fixing toner within a desired range may be dispersed within the binder resin. A positive polarity charge control agent or a negative polarity charge control agent is used for the charge control agent depending on whether the binder resin is to be positively or negatively charged. For example, a nigrosine dye, a quaternary ammonium salt, triphenylmethane derivative or the like may be used for the positive polarity charge control agent. In addition, a metalized azo complex, a naphtholzinc complex, a salicylic zinc acid complex, a Calixarene-based compound or the like may be used for the negative polarity charge control agent.

When the toner charge becomes excessively high, the amount of the optical fixing toner adhering on the photoconductive insulator becomes small to thereby make the printing tone light. On the other hand, when the toner charge becomes low, the printing tone becomes dark, and the optical fixing toner may even adhere to unnecessary portions of the photoconductive insulator. Accordingly, it is important to control the charge of the optical fixing toner within a desired range in order to achieve an appropriate printing.

An amount of the charge control agent to be added to the optical fixing toner may be selected arbitrarily. But in a case where the charge control agent content within the optical fixing toner is larger than approximately 5.0 wt. %, the charge characteristic of the optical fixing toner easily becomes unstable and cause excessive charging or the like. On the other hand, in a case where the charge control agent content within the optical fixing toner is less than approximately 0.1 wt. %, it is in most cases not possible to obtain the effect of sufficiently controlling the charge of the optical fixing toner. Accordingly, it is desirable that the control agent content within the optical fixing toner is in a range of approximately 0.1 to approximately 5.0 wt. %.

In addition, the optical fixing toner of the present invention includes a lanthanoide-based compound as an infrared ray absorbing agent, that is, as an essential component. The present inventors have found that compared to the conventional infrared ray absorbing agents made of the aminium-salt-based compound or the like, the infrared ray absorbing agent made of the lanthanoide-based compound has a smaller light absorption in the visible region, smaller effect on the original color tone of the optical fixing toner, and chemically mode stable. Accordingly, the optical fixing toner is particularly effective when used for a color toner.

The lanthanoide-based compound is an inorganic material having a crystal structure, and is chemically stable compared to the conventional organic materials such as the aminium-salt-based or diimomium-salt-based infrared ray absorbing agent. Hence, even when a polar compound such as tertiary amine having portions with high polarity or, a highly reactive ionic compound such as quaternary ammonium salt is used for the charge control agent, it is possible to suppress a structural change in both the lanthanoide-based compound and the charge control agent.

For this reason, the optical fixing toner can be fixed on the recording medium by appropriately transforming the energy of the infrared ray into heat, without deteriorating the infrared ray absorbing characteristic of the infrared ray absorbing agent and without deteriorating the charge control characteristic of the charge control agent. In addition, since it is difficult for a structural change or reaction to occur in the infrared ray absorbing agent, it is possible to avoid the color tone from being changed by such a structural change or reaction.

Suitable lanthanoide-based compounds for use as the infrared ray absorbing agent are compounds including lanthanoide-based elements such as La, Ce, Pr, Nd, Sm, Eu, Gd, Tb, Dy, Ho, Er, Yb and Lu. Compounds of such elements and an oxide, a sulfide, a halide, an acid chloride or the like are particularly suitable for use as the infrared ray absorbing agent.

Examples of such particularly suitable compounds for use as the infrared ray absorbing agent are: an oxide of a lanthanoide-based element such as ytterbium oxide, neodymium oxide, samarium oxide and the like; a sulfide of a lanthanoide-based element such as ytterbium sulfide, neodymium sulfide, samarium sulfide, cerium sulfide and the like; a halide of a lanthanoide-based element such as ytterbium fluoride, samarium fluoride, neodymium fluoride, ytterbium bromide, gadolinium bromide and the like; and an acid chloride of a lanthanoide-based element such as ytterbium chloride, samarium chloride, neodymium chloride and the like.

A salt of a lanthanoide-based element and an acid can also be used effectively as the infrared ray absorbing agent. In this case, the acids which may be used include cinnamic acid, phosphoric acid, carbonic acid, sulfuric acid, naphthoic acid, boric acid, molybdic acid, acetic acid, nitric acid, perchloric acid and the like. Moreover, examples of the salt which may be used as the infrared ray absorbing agent include ytterbium sulfate, neodymium sulfate, samarium sulfate, ytterbium nitrade, terbium nitrade, ytterbium perchlorate, ytterbium carbonate, indium carbonate, ytterbium acetate, ytterbium niacine, ytterbium phosphate, samarium phosphate, neodymium phosphate, ytterbium oxalate, terbium oxalate, thulium oxalate, neodymium cinnamate, neodymium naphthonate and the like.

In addition, it is possible to use as the infrared ray absorbing agent an oxygen-including acid chloride compound which includes one or more lanthanoide-based elements. Examples of such oxygen-including acid chloride compounds include an orthophosphate compound, a vanadate compound, a borate compound, a molybdic acid compound and the like.

Further, it is possible to use as the infrared ray absorbing agent a lanthanoide substitution complex salt which includes one or more lanthanoide-based elements. Examples of such lanthanoide substitution complex salt include a ytterbium-neodymium phosphate complex salt, a ytterbium-neodymium cinnamate complex salt, a ytterbium-neodymium naphthonate complex salt, neodymium-ytterbium cinnamate complex salt, a neodymium-ytterbium benzoate complex salt, a neodymium-ytterbium naphthonate complex salt and the like.

Particularly when considering the use of the optical fixing toner for the color toner, it is effective to use an ytterbium-based compound or a neodymium-based compound having a high absorption in the infrared region of the non-visible region as the infrared ray absorbing agent since such compounds are white and do not absorb visible light. Furthermore, a colored samarium-based compound having absorption in the yellow region and the infrared region is extremely effective in that such a compound is suitable for use as the infrared ray absorbing agent for a yellow-based fixing toner and also has the function of a yellow coloring agent which is normally difficult to adjust. Hence, it is desirable that the infrared ray absorbing agent is basically made of a ytterbium-based compound, and is added with a neodymium-based compound or a samarium-based compound if necessary.

As a method of adding the lanthanoide-based compound with respect to the optical fixing toner, it is possible to selectively employ one of or employ both of an internally adding method which is conventionally used to knead the lanthanoide-based compound within the binder resin and an externally adding method which adds the lanthanoide-based compound to surfaces of the toner grains (hereinafter simply referred to as a toner grain surface). Unlike the conventional organic infrared ray absorbing agent, the lanthanoide-based compound is a stable inorganic compound which makes it possible to employ the externally adding method described above.

Therefore, as described above, even in a case where the lanthanoide-based compound contacts a highly reactive charge control agent or the like by employing the internally adding method, the infrared ray absorbing characteristic of the lanthanoide-based compound will not deteriorate or adversely affect the constituent components of the optical fixing toner due to a reaction or the like. As a result, the lanthanoide-based compound which is uniformly dispersed in the toner grains positively promotes melting of the binder resin when optically fixing the optical fixing toner.

In addition, in a case where the lanthanoide-based compound is added to the toner grain surface by the externally adding method, the lanthanoide-based compound will not become embedded within the binder resin. For this reason, the irradiated light can be used as it is without via the binder resin, and the light utilization efficiency can be improved.

By employing both the internally adding method and the externally adding method described above, it is possible to make adjustments so that a desirable infrared ray absorbing function of the lanthanoide-based compound is obtained. When considering the relatively high cost of the lanthanoide-based compound, it is preferable that the lanthanoide-based compound is in a uniformly dispersed state in the vicinity of the thermally fixing binder resin, as the infrared ray absorbing agent. Thus, from the point of view of suppressing the amount of lanthanoide-based compound which is added to the optical fixing toner, it is preferable to employ the internally adding method.

If the lanthanoide-based compound content within the optical fixing toner is too small, it is not possible to give the optical fixing toner an infrared ray absorbing characteristic with a sufficiently large absorption. On the other hand, if the lanthanoide-based compound content within the optical fixing toner is too large, the cost of the raw materials used for the optical fixing toner becomes high. Accordingly, the lanthanoide-based compound content within the optical fixing toner is preferably in a range of approximately 0.5 to approximately 10 wt. %, and particularly preferable to be in a range of approximately 1 to approximately 8 wt. %.

The lanthanoide-based compound has a strong absorption peak in the infrared region. Although the absorption wavelength range of the lanthanoide-based compound is relatively narrow, it is possible to combine a plurality of lanthanoide-based compounds having different absorption regions, so as to design an infrared ray absorbing agent which can effectively utilize the energy of the light irradiated thereon. In addition, an existing infrared ray absorbing agent such as an aminium-salt-based compound described by the following formula (1), a diimomium-salt-based compound described by the following formula (2) and the like having an infrared ray absorption region different from that of the lanthanoide-based compound may be used together with the lanthanoide-based compound, so as to obtain an infrared ray absorbing agent in which the various infrared ray absorbing characteristics are mutually compensated.

(1)

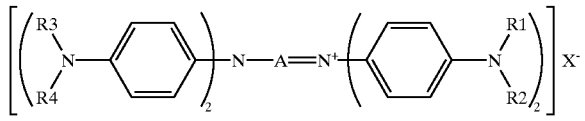

(2)

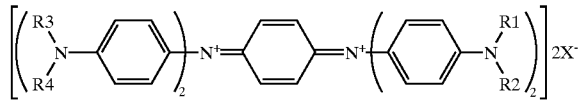

In the formulas (1) and (2) above, R1 through R4 denote hydrogen atom, alkyl group, substitution alkyl group, cyclic alkyl group, alkenyl group, alalkyl group or substitution alalkyl group, A denotes a p-phenylnene group or p-biphenylene group, and $X^-$ denotes negative ion.

In addition, when the grain diameter of the lanthanoide-based compound is greater than the toner grain diameter, the lanthanoide-based compound grains become free and are not dispersed within the optical fixing toner, thereby making it difficult to melt the optical fixing toner. Hence, it is desirable that the grain diameter of the lanthanoide-based compound is less than the toner grain diameter. From the point of view of increasing the light receiving area and effectively transforming the optical energy into the thermal energy, it is more advantageous to make the grain diameter of the lanthanoide-based compound small, and it is desirable that the average grain diameter is approximately 2 $\mu$m or less. On the other hand, if the grain diameter of the lanthanoide-based compound is too small, the flowability of the material by itself deteriorates and makes it difficult to handle the lanthanoide-based compound during the fabrication process, and from this point of view, it is desirable that the average grain diameter is approximately 0.01 $\mu$m or greater. Therefore, the grain diameter of the lanthanoide-based compound is preferably in a range of approximately 0.01 to approximately 2 $\mu$m, and particularly preferable to be in a range of approximately 0.05 to approximately 1 $\mu$m.

Other components may be added to the optical fixing toner to be dispersed within the binder resin if necessary. Such other components include waxes such as polypropylene wax, polyethylene wax, carnauba wax and ester wax, metallic soaps such as zinc stearate, and fixing supplement such as surface-active agent. In addition, a fluidization agent such as silica and titanium oxide may be externally added to the toner grain surface.

When fabricating the optical fixing toner according to the present invention by internally adding the lanthanoide-based compound, the binder resin, the coloring agent and the lanthanoide-based compound are prepared, and the charge control agent, the infrared ray absorbing agent such as the aminium-based compound, the wax and the fixing supplement are admixed if necessary. By melting the binder resin, a bulk is formed in which each of the constituent components of the optical fixing toner are dispersed within the binder resin. The optical fixing toner is obtained by solidifying the bulk, and finely grinding the solidified bulk to grains having a diameter in a range of approximately 1 to approximately 30 $\mu$m. The optical fixing toner may be used in this state as a developing agent or, may be used as a developing agent after adhering a fluidization agent or the like to the toner grains if necessary.

On the other hand, when fabricating the optical fixing toner according to the present invention by externally adding the lanthanoide-based compound, the binder resin and the coloring agent are prepared, and the charge control agent and the infrared ray absorbing agent such as the aminium-based compound, the wax and the fixing supplement are admixed if necessary. By melting the binder resin, a bulk is formed in which each of the constituent components of the optical fixing toner are dispersed within the binder resin. The optical fixing toner is obtained by solidifying the bulk, and finely grinding the solidified bulk to grains having a diameter in a range of approximately 1 to approximately 30 $\mu$m. The optical fixing toner may be used as a developing agent after adhering the lanthanoide-based compound on the toner grains together with a fluidization agent or the like.

Furthermore, after fabricating the optical fixing toner by the internally adding method, it is possible to externally add the lanthanoide-based compound together with the fluidization agent or the like. In other words, both the internally adding method and the externally adding method may be employed to fabricate the optical fixing toner. In this case, the lanthanoide-based compounds used for the internally adding method and the externally adding method may be of the same or different kinds, but it is desirable to select the lanthanoide-based compounds so that the infrared absorbing regions thereof are mutually compensated.

The optical fixing toner which is obtained in the above described manner may be used to form images by various developing methods of the electrophotography technique, such as the nonmagnetic single-component developing method and the two-component developing method.

When using the two-component developing method, the optical fixing toner is mixed and agitated within a developing unit arranged with a magnet roller, together with a ferromagnetic carrier such as ferrite and iron powder. The optical fixing toner is charged by the friction with the ferromagnetic carrier caused by the agitation, and a magnetic brush of the optical fixing toner is formed on the surface of the rotating magnet roller. Normally, a photoconductive insulator such as a photoconductive drum is arranged adjacent to the magnet roller, and as described above, an electrostatic latent image is formed on this photoconductive insulator. Accordingly, a portion of the magnetic brush formed by the optical fixing toner on the magnet roller is transferred to the surface of the photoconductive insulator by the electrical attracting force, thereby developing the electrostatic latent image into a toner image.

This toner image is transferred onto a recording medium such as paper, and an infrared ray is irradiated on the toner image to optically fix the toner image on the recording medium. For example, the energy of the infrared flash is in a range of approximately 0.5 to approximately 3.0 J/cm$^2$, and the infrared irradiation time is approximately 500 to approximately 3000 $\mu$s when carrying out this optical fixing process.

Embodiment

An embodiment of the optical fixing toner according to the present invention will now be described with reference to comparison examples. Unless specifically indicated, it is assumed in the following description that the average grain diameter of the lanthanoide-based compound which is added is approximately 0.3 $\mu$m.

(Fabrication of Toner 1)

89.0 wt. % of polyester resin as the binder resin, 1.0 wt. % of Calixarene-based compound as the negative polarity charge control agent, 4.0 wt. % of quinacridone-based red pigment as the coloring agent, 1.0 wt. % of polypropylene-based wax as the fixing supplement, and 5 wt. % of ytterbium phosphate were put into a mixer and mixed in advance. Then, the mixture was melted and kneaded so as to obtain a bulk in which each of the constituent components of the optical fixing toner are dispersed within the binder resin. This bulk was solidified, and then finely ground to obtain a negative charge type red toner base having an average grain diameter of approximately 8 $\mu$m. An optical fixing toner in which the infrared ray absorbing agent is internally added was obtained by externally adding 0.8 wt. % of hydrophobic silica to this negative charge type red toner base.

The polyester resin used had ethylene oxide of bisphenol-A as the primary diol component and terephthalic acid as the primary carboxylic acid component.

(Fabrication of Toners 2 through 38)

The toners 2 through 38 were fabricated using the components and contents shown in FIGS. 1A through 3B, by a toner fabrication method similar to that used to fabricate the toner 1 described above. FIGS. 1A, 1B, 2A, 2B, 3A and 3B are diagrams showing components of the developing agent and the mixture ratios thereof in this embodiment of the optical fixing toner according to the present invention, for the toners 1 through 38.

The toners 1 through 15 shown in FIGS. 1A, 1B and 2A were fabricated using lanthanoide-based compounds as the infrared ray absorbing agent. For example, the toner 1 uses ytterbium phosphate ($Yb_2PO_4$) as the lanthanoide-based compound, and the toner 15 uses ytterbium-neodymium phosphate complex salt ($YbNdPO_4$) as the lanthanoide-based compound. The lanthanoide-based compound content within the optical fixing toner is 5 wt. % for the toners 1 through 15.

The toners 16 through 19 shown in FIGS. 2A and 2B use ytterbium phosphate as the lanthanoide-based compound, and the lanthanoide-based compound contents within the optical fixing toner respectively are 0.1, 20.0, 0.0 and 24.0. In other words, the toner 18 is a comparison example having no lanthanoide-based compound content within the optical fixing toner.

The toners 20 through 23 shown in FIG. 2B use ytterbium phosphate as the lanthanoide-based compound, and the lanthanoide-based compound contents within the optical fixing toner respectively are 5 wt. % but having different coloring agent (quinacridone-based red pigment) contents.

The toners 24 through 27 shown in FIGS. 2B and 3A use ytterbium phosphate as the lanthanoide-based compound, and the lanthanoide-based compound contents within the optical fixing toner respectively are 5 wt. % but having different charge control agent (Calixarene-based compound) contents.

The toner 28 shown in FIG. 3A includes 0.5 wt. % of ytterbium phosphate as the externally adding agent. In other words, the toner 28 is internally and externally added with the infrared ray absorbing agent made of the lanthanoide-based compounds described above. In addition, the toner 29 shown in FIG. 3A includes 5 wt. % of ytterbium phosphate as the externally adding agent but including no internally adding agent. Hence, the toner 29 is externally added with the infrared ray absorbing agent made of the lanthanoide-based compound described above.

The toners 30 through 34 shown in FIGS. 3A and 3B use a combination of the lanthanoide-based compound (ytterbium phosphate) and aminium-salt-based compound or diimomium-salt-based compound as the infrared ray absorbing agent.

The toners 35 and 36 shown in FIG. 3B use the conventional aminium-salt-based compound or a diimomium-salt-based compound as the infrared ray absorbing agent.

Further, the toners 37 and 38 shown in FIG. 3B use ytterbium phosphates having grain diameters different from that of the toner 1. The grain diameter is adjusted to approximately 2 μm for the toner 37, and the grain diameter is adjusted to approximately 0.1 μm for the toner 38. Otherwise the toners 37 and 38 are the same as the toner 1.

The toners 1 through 38 described above were mixed with a ferrite carrier having an average grain diameter of 60 μm with a toner concentration of 4.5%, to obtain corresponding two-component developing agents 1 through 38.

The following evaluation tests were conducted with respect to the two-component developing agents 1 through 38, and the results shown in FIGS. 4A and 4B were obtained. FIGS. 4A and 4B are diagrams showing the results of evaluation tests conducted with respect to the developing agents 1 through 38 of this embodiment.

(Print Evaluation Test)

The developing agents 1 through 38 were tested on a modified version of a printer FK6718K manufactured by Fujitsu Limited of Japan. The printer FK6718K is originally designed to use a positive charge type toner, but was modified to use a negative charge type toner. A xenon flash from a light source having a high light emission intensity in a wavelength range of 700 to 1500 nm was irradiated on a toner image formed on a plain paper to fix the toner image. A plain paper NIP-1500LT (product name) manufactured by Kobayashi Recording Paper Company of Japan was used as the plain paper. A tape separation test which will be described later was carried out with respect to the plain paper, to evaluate the fixing performance.

In FIGS. 4A and 4B, the fixing performance, that is, the change in image printing tone, is indicated by a symbol ○ for 10% or less, a symbol ◎ for 5% or less, and a symbol X for over 10%.

(Charge Evaluation Test)

The printer described above was used to continuously print images on 100,000 prints, and the change in the charge was measured in the initial state and after the printing of the 100,000 prints, so as to evaluate the charging performance. In FIGS. 4A and 4B, the initial charge and the charge after the printing of the 100,000 prints are indicated in μ C/g. In addition, the charging performance is indicated by a symbol ○ for 60% or greater, a symbol ◎ for 80% or greater, and a symbol X for less than 60% with respect to the charge in the initial state.

(Image Evaluation Test)

The images on the prints described above were evaluated, with respect to the red image, by measuring L, a* and b* values of the color space using a spectrodensitometer X-Rite 938 manufactured by X-Rite, Inc. of the U.S.A. The color tone of the toner 18 was used as a reference since it includes no infrared ray absorbing agent and no change of color occurs during the fixing process, and the light, darkish and dark states of the color tone were measured. In FIGS. 4A and 4B, the image evaluation is indicated by a symbol ◎ for equivalent color tones, a symbol ○ for color tones with slight color differences but having satisfactory qualities, and a symbol X for color tones with large color differences and unsatisfactory qualities.

(Fixing Evaluation Test)

First, the image printing tone on the plain paper having the toner image fixed thereon was measured as the optical density. Then, a separating tape was adhered on the toner image fixed on the plain paper. A "Scotch Mending Tape" (product name) manufactured by Sumitomo 3M Company of Japan was used as the separating tape. The adhered separating tape was then removed, and the optical density on the plain paper after the removal was measured. The image printing tone on the plain paper after the removal of the separating tape was represented by a percentage with respect to the image printing tone on the plain paper before the removal of the separating tape, where the image printing tone before the removal is represented by 100. The change in the image printing tone, represented by the percentage of the image printing tone after the removal of the separating tape with respect to the image printing tone before the removal of the separating tape, was used as the fixing performance for evaluating the strength of the fixing. A Macbeth PCM meter was used for the measurement of the optical density.

From FIGS. 4A and 4B which shows the results of the evaluation test conducted with respect to the developing agents 1 through 38, it was confirmed that the conventional developing agents 35 and 36 are usable, but have poorer charging performances and image evaluations which need to be improved when compared to the developing agents of the present invention. It may be regarded that the poorer charging performances and image evaluations are caused by the deteriorated performance of the charge control agent due to the infrared ray absorbing agent such as the aminium- based salt, as described above.

It was also confirmed from FIG. 4A that the developing agents 1 through 15 of this embodiment show satisfactory fixing performance, image evaluation and charging performance. It was confirmed particularly from the developing agents 1 through 5 and 8 that desirable results are obtained by use of the ytterbium-based compound or the neodymium-based compound. It was also confirmed from the developing agent 15 that it is desirable to use compounds such as complex salts of ytterbium and neodymium.

It was also confirmed from the developing agents 1 and 16 through 19 shown in FIGS. 4A and 4B that the addition of the ytterbium-based compound becomes effective when the added content is approximately 0.1 wt. % or greater but not exceeding approximately 20.0 wt. %.

It was further confirmed from the developing agents 28 and 29 shown in FIG. 4B that the addition of the ytterbium-based compound is effective, regardless of whether both the internally adding method and the externally adding method are employed or, the externally adding method is employed.

In the case of the toners using both the ytterbium-based compound and the aminium-based compound as in the case of the developing agents 30 through 34 shown in FIG. 4B, it was confirmed from the developing agent 32, for example, that desirable developing agents can be designed by appropriately adjusting contents of the ytterbium-based compound and the aminium-based compound.

In FIG. 4B, the developing agents 37 and 38 use ytterbium-based compounds having grain diameters different from that used by the developing agent 1. The developing agent 37 which uses the ytterbium-based compound having a grain diameter larger than that of the developing agent 1 showed a slight deterioration in the fixing performance as compared to the developing agent 1, but it was confirmed that the fixing performance of the developing agent 37 is still at an acceptable level. The developing agent 37 which uses the ytterbium- based compound having a grain diameter smaller than that of the developing agent 1 showed a slight deterioration in the handling performance during the fabrication as compared to the developing agent 1, but it was confirmed that the performances of the developing agent 37 is at an acceptable level.

Further, the present invention is not limited to these embodiments, but various variations and modifications may be made without departing from the scope of the present invention.

What is claimed is:

1. An optical fixing toner comprising:

a first component, which is a binder resin, a coloring agent or a charge control agent and an infrared ray absorbing agent made of one element or a mixture of a plurality of elements selected from a group of elements consisting of oxides, sulfides, halides, complex salts and acid chlorides of lanthanoide.

2. The optical fixing toner as claimed in claim 1, wherein a content of said infrared ray absorbing agent within the optical fixing toner is in a range of approximately 0.1 to 20.0 weight percent.

3. The optical fixing toner as claimed in claim 2, wherein at least a portion of said infrared ray absorbing agent is externally added to surfaces of toner grains forming the optical fixing toner.

4. The optical fixing toner as claimed in claim 3, wherein the lanthanoide is made of an element selected from a group of elements consisting of salts, complex salts and oxides of ytterbium, neodymium and samarium.

5. The optical fixing toner as claimed in claim 2, wherein the lanthanoide is made of an element selected from a group of elements consisting of salts, complex salts and oxides of ytterbium, neodymium and samarium.

6. The optical fixing toner as claimed in claim 1, wherein the lanthanoide is made of an element selected from a group of elements consisting of salts, complex salts and oxides of ytterbium, neodymium and samarium.

7. The optical fixing toner as claimed in claim 1, wherein said first component is a binder resin, and further comprising:

a second component which is a coloring agent or a charge control agent.

8. The optical fixing toner as claimed in claim 1, wherein said first component is a coloring agent, and further comprising:

a second component which is a binder resin or a charge control agent.

9. The optical fixing toner as claimed in claim 1, wherein said first component is a charge control agent, and further comprising:

a second component which is a coloring agent or a binder.

10. The optical fixing toner as claimed in claim 1 wherein the optical fixing toner comprises a charge control agent, a coloring agent and a binder.

11. optical fixing toner comprising:

an infrared ray absorbing agent made of one element or a mixture of a plurality of elements selected from a group o elements consisting of oxides, sulfides, halides, complex salts and acid chlorides of lanthanoide, and further comprising:

an aminium-salt-based compound described by a formula (1), and/or a diimomium-salt-based compound described by a formula (2).

(1)

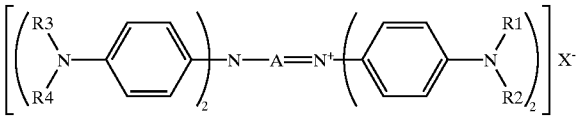

-continued (2)

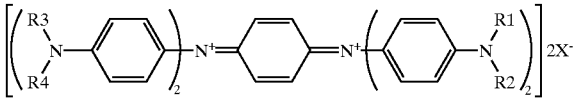

wherein R1 through R4 denote hydrogen atom, alkyl group, substitution alkyl group, cyclic alkyl group, alkenyl group, alalkyl group of substitution alalkyl group. A denotes a p-phenylnene group or a p-biphenyl group, and $X^-$ denotes negative ion.

12. An optical fixing toner, comprising:

infrared ray absorbing agent made of one element or a mixture of a plurality of elements selected from a group of elements consisting of oxides, sulfides, halides, complex salts and acid chlorides of lanthanoide.

wherein a content of said infrared ray absorbing agent within the optical fixing toner is in a range of approximately 0.1 to 20.0 weight percent and further comprising:

an aminium-salt-based compound described by a formula (1), and/or a diimomium-salt-based compound described by a formula (2), (1)

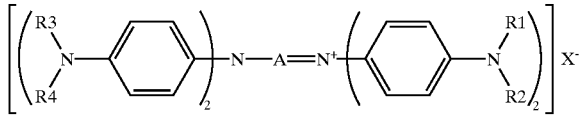

(2)

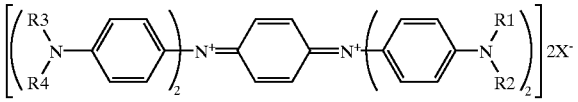

wherein R1 through R4 denote hydrogen atom, alkyl group, substitution alkyl group, cyclic alkyl group, alkenyl group, alalkyl group or substitution alalkyl group, A denotes a p-phenylnene group or p-biphenylene group, and $X^-$ denotes negative ion.

13. An optical fixing toner, comprising:

an infrared ray absorbing agent made of one element or a mixture of a plurality of elements selected from a group of elements consisting of oxides, sulfides, halides, complex salts and acid chlorides of lanthanoide, wherein a content of said infrared ray absorbing agent within the optical fixing toner is in a range of approximately 0.1 to 20.0 weight percent, wherein at least a portion of said infrared ray absorbing agent is externally added to surfaces of toner grains forming the optical fixing toner, and further comprising:

an aminium-salt-based compound described by a formula (1), and/or a diimomium-salt-based compound described by a formula (2), (1)

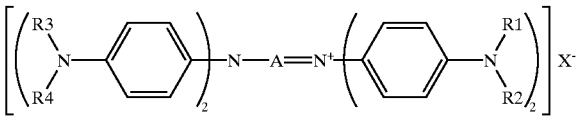

(2)

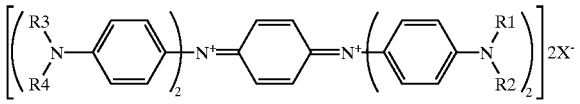

wherein R1 through R4 denotes hydrogen atom, alkyl group, substitution alkyl group, cyclic alkyl group, alkenyl group, alalkyl group or substitution alalkyl group, A denotes a p-phenylnene group or p-biphenylene group, and $X^-$ denotes negative ion.

14. An optical fixing toner, comprising:

an infrared ray absorbing agent made of one element or a mixture of a plurality of elements selected from a group of elements consisting of oxides, sulfides, halides, complex salts and acid chlorides of lanthanoide, Wherein the lanthanoide is made of an element selected from a group of elements consisting of salts, complex salts and oxides of ytterbium, neodymium and samarium, and further comprising:

an aminium-salt-based compound described by a formula (1), and/or a diimomium-salt-based compound described in formula (2).

(1)

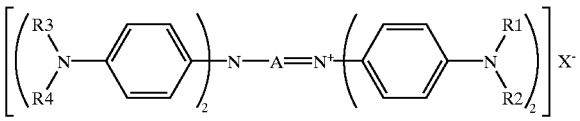

-continued (2)

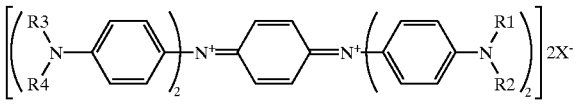

wherein R1 through R4 denote hydrogen atom, alkyl group, substitution alkyl group, cyclic alkyl group, alkenyl group, alalkyl group or substitution alalkyl group, A denotes a p-phenylnene group or p-biphenylene group, and $X^-$ denotes negative ion.

15. An optical fixing toner for use in forming images by a non-magnetic single-component developing method or a two-component developing method of an electrophotography technique, said optical fixing toner comprising:

an infrared ray absorbing agent made of one element or a mixture of a plurality of elements selected from a group of elements consisting of oxides, sulfides, halides, complex salts and acid chlorides of lanthanoide:

wherein said toner is characterized in producing images that can be melted and fixed on a recording medium when irradiated with light.

16. The optical fixing toner as claimed in claim 15, further comprising:

a ferromagnetic carrier powder, so that the images are formed by the two-component developing method.

* * * * *